US007163384B2

(12) United States Patent
Lilie et al.

(10) Patent No.: US 7,163,384 B2
(45) Date of Patent: Jan. 16, 2007

(54) RECIPROCATING COMPRESSOR WITH A LINEAR MOTOR

(75) Inventors: Dietmar Erich Bernhard Lilie, Joinville-SC (BR); Rinaldo Puff, Joinville-SC (BR)

(73) Assignee: Empresa Brasileira de Compressores S.A. -Embraco, Joinville (BR)

( * ) Notice: Subject to any disclaimer, the term of this patent is extended or adjusted under 35 U.S.C. 154(b) by 611 days.

(21) Appl. No.: 10/468,546

(22) PCT Filed: Feb. 20, 2002

(86) PCT No.: PCT/BR02/00027

§ 371 (c)(1),
(2), (4) Date: Oct. 15, 2003

(87) PCT Pub. No.: WO02/066830

PCT Pub. Date: Aug. 29, 2002

(65) Prior Publication Data

US 2004/0115076 A1 Jun. 17, 2004

(30) Foreign Application Priority Data

Feb. 21, 2001 (BR) ..... 0100781

(51) Int. Cl.

| | |
|---|---|
| ***F04B 17/04*** | (2006.01) |
| ***F04B 49/00*** | (2006.01) |
| ***F04B 39/10*** | (2006.01) |
| ***F16F 1/06*** | (2006.01) |

(52) U.S. Cl. ..... 417/417; 417/15; 417/416; 417/363; 417/570; 267/179

(58) Field of Classification Search ..... 417/15, 417/417, 416, 363, 570; 403/12, 14, 229; 267/167, 170, 179

See application file for complete search history.

(56) References Cited

U.S. PATENT DOCUMENTS 4,121,125 A 10/1978 Dolz

*Primary Examiner*—Ehud Gartenberg
*Assistant Examiner*—Ryan Gillan
(74) *Attorney, Agent, or Firm*—Darby & Darby

(57) ABSTRACT

A reciprocating compressor with a linear motor having an actuating means operatively coupling a reciprocating piston to the motor; and a resonant spring means mounted under constant compression to the actuating means by the mutual seating of a pair of supporting surface portions, at least one of the latter being operatively associated with one of the spring means and the actuating means, against a respective pair of convex surface portions, each of the latter being operatively associated with the other of said parts, the convex surface portions being symmetrical and opposite in relation to the axis of cylinder, the supporting surface portions and the convex surface portions being mutually seated and operatively associated with the respective parts of the spring means and the actuating means, in order to transmit, by the mutually seated surface portions, the opposite axial forces with such intensity as to minimize the moments on the piston.

16 Claims, 6 Drawing Sheets

RECIPROCATING COMPRESSOR WITH A LINEAR MOTOR

This is a U.S. national phase application under 35 U.S.C. §371 of International Patent Application No. PCT/BR2002/00027 filed Feb. 20, 2002 and claims the benefit of Brazilian Application No. PI 0100781-5 filed Feb. 21, 2001. The International Application was published in English on Aug. 29, 2002 as International Publication No. WO/02/066830 under PCT Article 21(2). Both application are incorporated herein by reference.

FIELD OF THE INVENTION

The present invention refers, in general, to a reciprocating compressor driven by a linear motor, to be applied to refrigeration systems and presenting a piston reciprocating inside a cylinder. More specifically, the invention refers to a coupling between the piston and a resonant system associated therewith.

BACKGROUND OF THE INVENTION

In a reciprocating compressor driven by a linear motor, the gas compression and gas suction operations are performed by axial movements of each piston reciprocating inside a cylinder, which is closed by a cylinder head and mounted inside a hermetic shell, in the cylinder head being positioned the discharge and the suction valves, which regulate the admission and discharge of gas in relation to the cylinder. The piston is driven by an actuating means, which carries magnetic components operatively associated with a linear motor affixed to the shell of the compressor.

In some known constructions, each piston-actuating means assembly is connected to a resonant spring affixed to the hermetic shell of the compressor, in order to operate as a guide for the axial displacement of the piston and to make the whole assembly actuate resonantly in a predetermined frequency, allowing the linear motor to be adequately dimensioned for continuously transferring energy to the compressor during operation of the latter.

In a known construction, two helical springs are mounted under compression against the actuating means on each side thereof. The piston, the actuating means, and the magnetic component form the resonant assembly of the compressor, which assembly is driven by the linear motor and has the function of developing a reciprocating linear movement, making the movement of the piston inside the cylinder exert compression on the gas admitted by the suction valve, until said gas is discharged to the high pressure side through the discharge valve.

Helical springs under compression, independently of the shape of the last coil that will form the contact region with the piston, have the characteristic of promoting a contact force with an uneven distribution along a determined contact circumferential extension, with a concentration of compressive force in the region where the last coil begins contacting the piston.

According to calculations, 85% of the reaction force is applied to the first 10 degrees of the contact region (indicated by the angle β in FIG. 2), the remainder (15%) of the reaction force being distributed along the complement of the circumferential extension of the contact region. As a consequence, the piston is submitted, mainly when displaced from its resting position, to a momentum which causes a misaligned movement of said piston in relation to the cylinder, resulting in wears that decrease the life of the compressor and increase the occurrences of noise and vibration during operation thereof.

This effect is noted while each helical spring is operating as a spring in the assembly, since the compressive force on the actuating means is only equally distributed along the contact surface in the moment in which said helical spring achieves a solid length with all the coils, when said spring begins to act as a block. The occurrence of a momentum is present, although with less intensity, even in the constructions in which the last coil of said helical springs presents part of its extension flat.

SUMMARY OF THE INVENTION

Thus, it is an object of the present invention to provide a reciprocating compressor with a linear motor, of the type in which the spring means is constantly compressing the actuating means, with a simple construction and which minimizes the concentration effect of compressive forces on said actuating means and the consequent moments on the spring means and the piston.

This and other objects are attained by a reciprocating compressor with a linear motor, comprising a shell and a motor-compressor assembly including: a reference assembly affixed inside the shell and formed by a motor and a cylinder; a resonant assembly formed by a piston reciprocating inside the cylinder, and by an actuating means operatively coupling the piston to the motor; and a resonant spring means under constant compression, which is simultaneously mounted to the resonant assembly and to the reference assembly, and which is resiliently and axially deformable in the displacement direction of the piston, said spring means being mounted to the actuating means by the mutual seating of a pair of supporting surface portions, at least one of the latter being operatively associated with one of the parts of the spring means and the actuating means, against a respective pair of convex surface portions, each of the latter being operatively associated with the other of said parts, the convex surface portions being symmetrical and opposite in relation to the axis of the cylinder, the supporting surface portions and the convex surface portions being mutually seated and operatively associated with the respective parts of the spring means and the actuating means, in order to transmit, by the mutually seated surface portions, the opposite axial forces actuating on said parts, with such intensity as to minimize the occurrence of moments on the piston.

BRIEF DESCRIPTION OF THE DRAWINGS

The invention will be described below, with reference to the appended drawings, in which.

DESCRIPTION OF THE ILLUSTRATED EMBODIMENT

Figure 1:
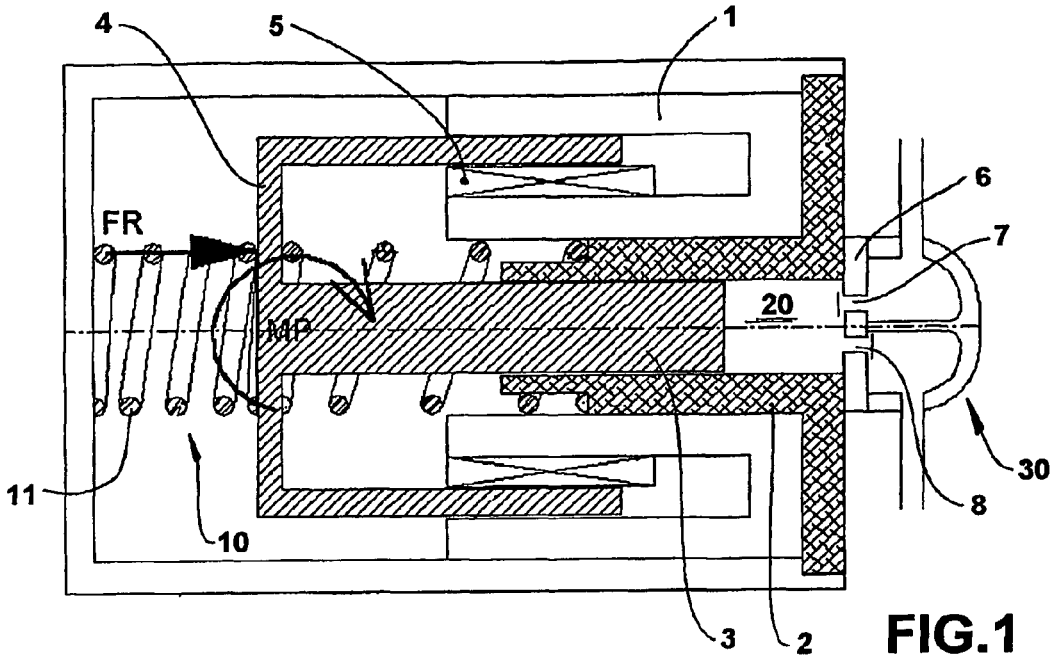
FIG.1 PRIOR ART
FIG. 1 illustrates, schematically, a longitudinal diametrical sectional view of a hermetic compressor of the type driven by a linear motor, presenting helical springs compressing an actuating means that couples the piston to the reciprocating linear motor, constructed according to the prior art and indicating the reaction force (FR) on the actuating means and the momentum (MP) existing on the piston.
Figure 2:
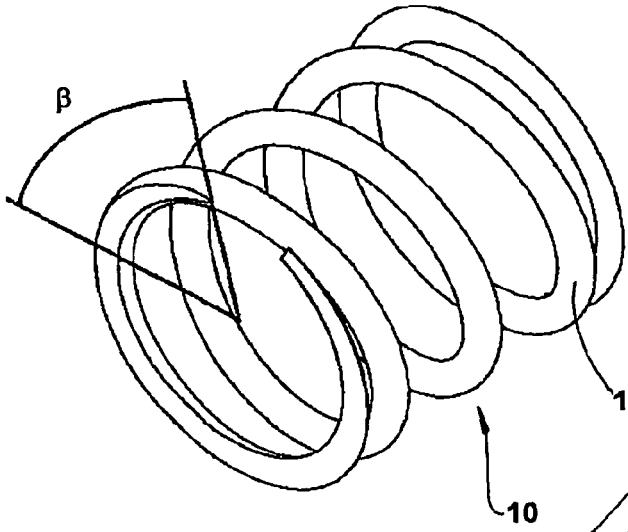
FIG. 2 illustrates, schematically, a perspective view of a spring of the spring means, constructed according to the present invention.
Figure 9:
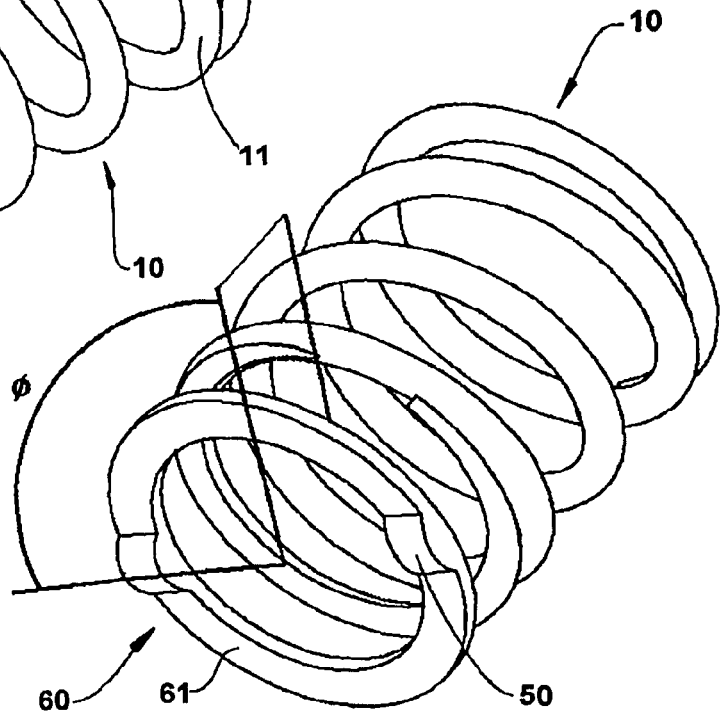
FIG. 9 illustrates, schematically and partially, an exploded perspective view of another constructive option of the present invention, presenting a spacing body to be seated onto an end portion of the spring means.
Figure 3:
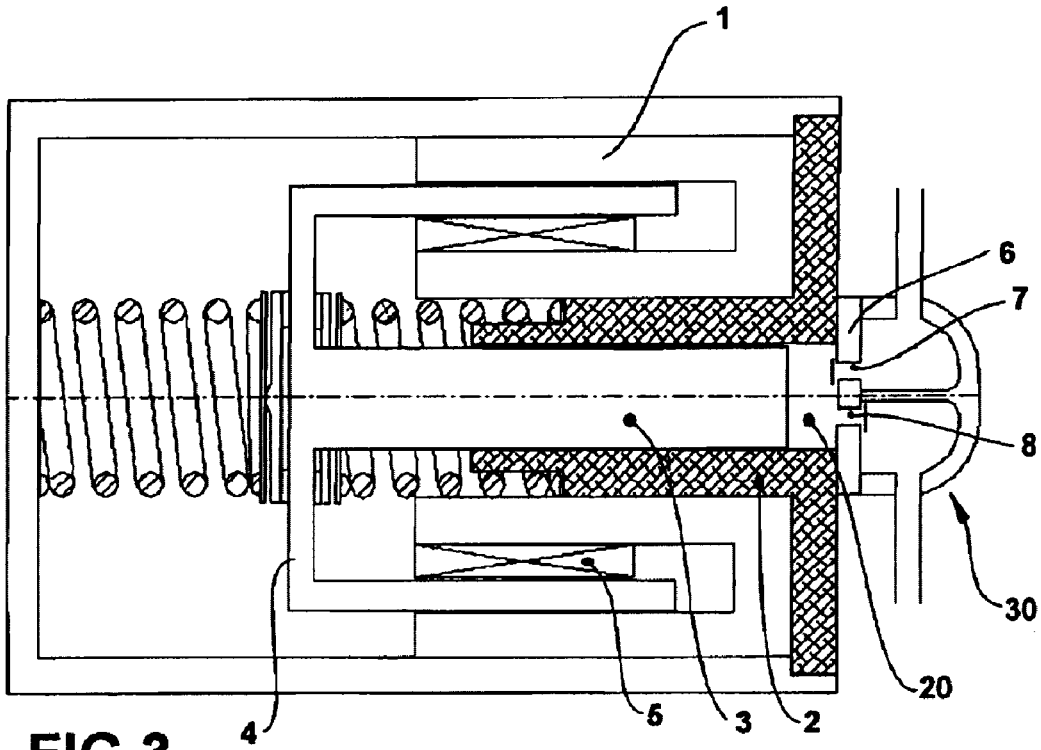
FIG. 3 illustrates, schematically, a longitudinal diametrical sectional view of a hermetic compressor such as that illustrated in FIG. 1, but presenting a coupling between the actuating means, the piston and the linear motor, obtained according to a spring means construction of the present invention.

The present invention will be described in relation to a reciprocating compressor driven by a linear motor, of the type used in refrigeration systems and comprising a hermetic shell, inside which is mounted a motor-compressor assembly, including a reference assembly affixed inside said shell and formed by a linear motor 1 and a cylinder 2, and a resonant assembly which is formed by a piston 3 reciprocating inside the cylinder 2, and by an actuating means 4 provided external to the cylinder 2 and carrying a magnet 5, which is axially impelled by energization of the linear motor 1, said actuating means 4 operatively coupling the piston 3 to the linear motor 1.

The compressor illustrated in FIG. 1 further includes a resonant spring means 10, which is simultaneously mounted, under constant compression, to the resonant assembly and to the reference assembly, and which is resiliently and axially deformable in the displacement direction of the piston 3. The spring means 10 includes, for example, a pair of helical springs 11, each being mounted against an adjacent surface of the actuating means 4.

In the embodiment illustrated in FIG. 1, the cylinder 2 has an end closed by a valve plate 6 provided with a suction valve 7 and a discharge valve 8, allowing the selective fluid communication between a compression chamber 20, which is defined between the top of the piston 3 and the valve plate 6, and the respective internal portions of a cylinder head 30 that are respectively maintained in fluid communication with the low and high pressure sides of the refrigeration system to which the compressor is coupled.

In the prior art construction illustrated in FIG. 1, each helical spring 11 has a respective end portion, having a last coil, which is seated against an adjacent surface actuating means 4, and an opposite end portion for fixation of the reference assembly. In this construction, during the operation of the piston 3 in the contact and seating region of each helical spring 11 against the actuating means 4, there is applied a compressive reaction force, indicated by FR in said FIG. 1, and which originates a momentum MP transmitted to the piston 3, causing misalignments to the latter that result, with time, in wears of said piston 3, as already discussed.

According to the present invention, the spring means 10 is mounted to the actuating means 4, by mutually seating a pair of supporting surface portions 40 (for example, in the form of concave or flat surface portions), at least one of them being operatively associated with one of the parts of the spring means 10 and the actuating means 4, against a respective pair of convex surface portions 50 (for example, spherical or cylindrical, with the axis orthogonal to the axis of the cylinder 2), each of them being operatively associated with the other of said parts, the convex surface portions 50 being symmetrical and opposite in relation to the axis of the cylinder 2 and defining an alignment in a plane that includes the axis, the supporting surface portions 40 and the convex surface portions 50 being mutually seated and operatively associated with the respective parts of the spring means 10 and the actuating means 4, in order to transmit, by the mutually seated surfaces portions, the opposite axial forces actuating on said parts, with such intensity that the momentum resulting on the piston 3 is minimum. With the constructions presented, the opposite axial forces actuating on said mutually seating parts present the same intensity, resulting in a null momentum on piston 3.

According to the illustrated constructive forms of the present invention, each pair of supporting surface portions 40 and each pair of convex surface portions 50 are operatively associated with the same respective part, as described below.

In a constructive variant of the present invention such as those illustrated in FIGS. 3–14, at least one of the pairs of the supporting surface portions 40 and the convex surface portions 50 is incorporated to a respective part of the actuating means 4 and the spring means 10.

In the constructive options presenting only one pair of convex surface portions 50 actuating on a respective pair of supporting surface portions 40, the alignment defined by the pair of convex surface portions 50 is angularly disposed in relation to the first contact portion of the spring means 10, in relation to the pair of supporting surface portions 40, in order to result in a minimum, preferably null, momentum condition on the piston 3. In order to obtain this result, the alignment between the pair of convex surface portions 50 and the respective pair of supporting surface portions 40 occurs at an angle $\phi$, taken from the seating direction of the spring means 10 to said contact portion and corresponding to a determined percentage of the concentration of the forces reacting against the compressive force of the spring means 10 higher than 50% the value of said compressive force, said angle $\Phi$ being particularly defined between 90 and 180 degrees from the seating direction of the last coil of the spring means 10 on the actuating means 4, preferably between 110 and 120 degrees and, more preferably, between 115 and 118 degrees.

According to a constructive form of the present invention, such as for example that illustrated in FIGS. 3–13, between at least one of the helical springs of the spring means 10 and the actuating means 4, there is provided a spacing body 60 in the form of a ring, for example flat, presenting two seating surfaces 61 lying on planes orthogonal to the axis of the cylinder 2 and which are axially spaced from each other, each of said surfaces facing a respective end surface adjacent to one of the parts of the spring means 10 and the actuating means 4, at least one of said seating surfaces 61 carrying one of the pairs of the convex surface portions 50 and the supporting surface portions 40, the other pair of said surfaces being defined in one of the parts of the actuating means 4 and the spring means 10.

In the constructions illustrated in FIGS. 3–5 and 7–13, at least one pair of convex surface portions 50 is defined in the spacing body 60, with the pair of supporting surface portions 40 being defined in one of the other parts of the spring means 10 and the actuating means 4.

In this construction, each helical spring of the spring means 10 is seated against a seating surface 61 of the spacing body 60, according to the above described seating angle, said spacing body 60 being seated against the actuating means 4 by the mutual seating of the pair of convex surface portions 50 provided in said spacing body 60 on a respective pair of supporting surface portions 40 defined on an adjacent surface of the actuating means 4.

Figure 14:
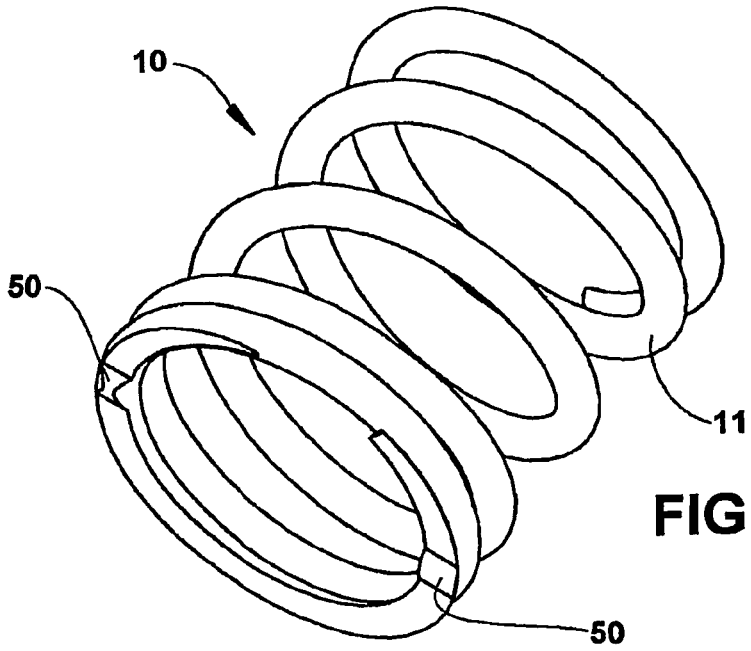
FIG. 14 illustrates, schematically, a perspective view of another possible constructive form of the present invention.

In the construction illustrated in FIG. 14, the pair of convex surface portions 50 is defined in the last coil of the helical spring of the spring means 10, and the pair of supporting surface portions 40 is defined, for example, on an adjacent surface of the actuating means 4.

Figure 13:
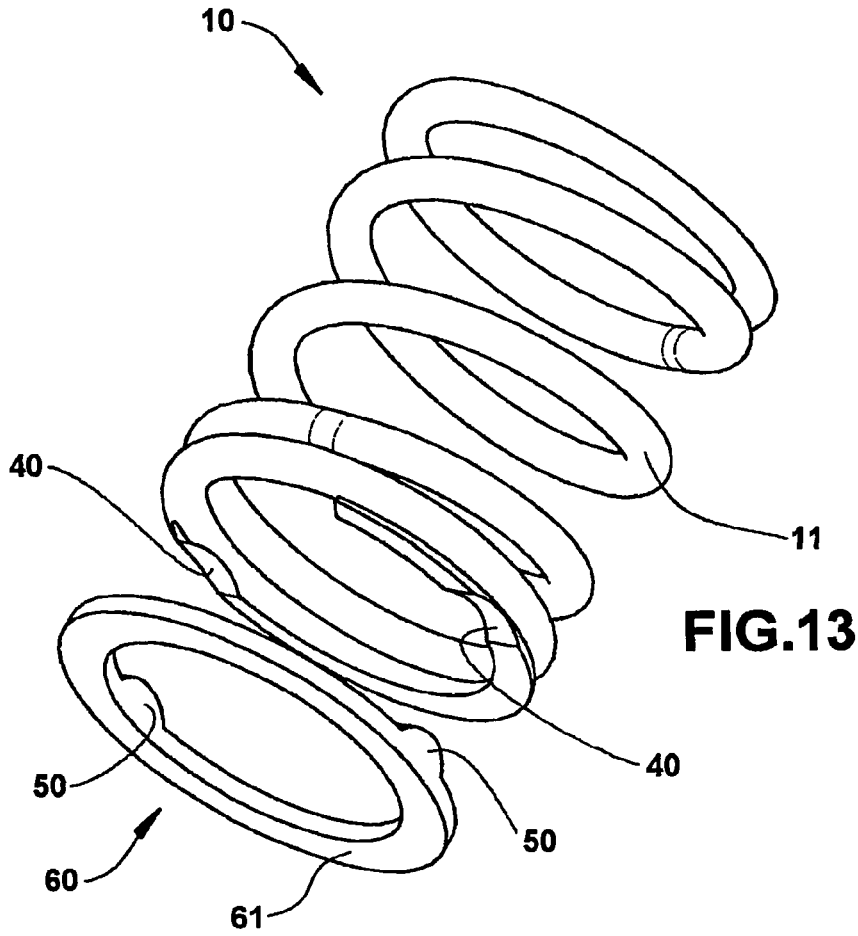
FIG. 13 illustrates, schematically, a perspective view of another possible constructive form of the present invention.

In the construction illustrated in FIG. 13, the spacing body 60 is seated, by a flat seating surface 61, against an adjacent surface of the actuating means 4, said spacing body 60 incorporating, in its other seating surface 61, the pair of convex surface portions 50 seated against a respective pair of supporting surface portions 40 defined, for example, in an adjacent end coil of a helical spring of the spring means 10, for example in the form of concavities provided in said end coil, according to the previously discussed seating angle.

Figure 6A:
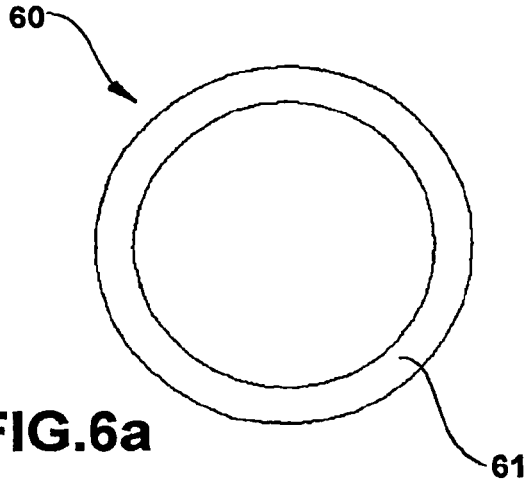
Figure 6C:
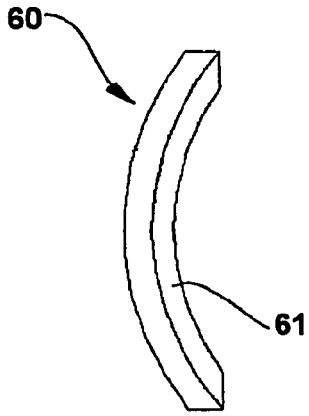
Figure 6B:
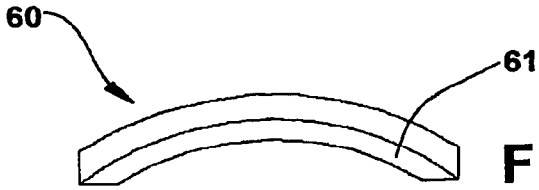
Figure 7A:
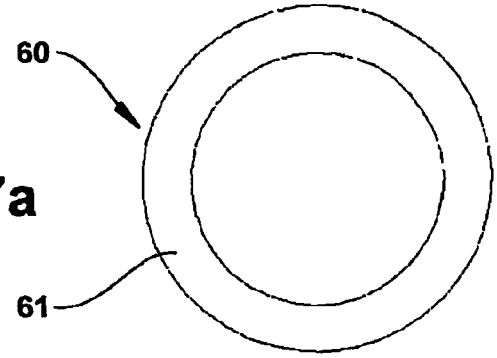
Figure 7B:
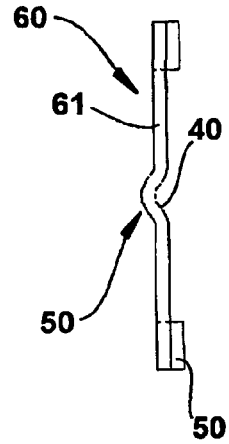
Figure 7C:
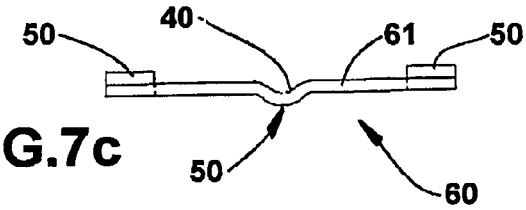
Figure 8A:
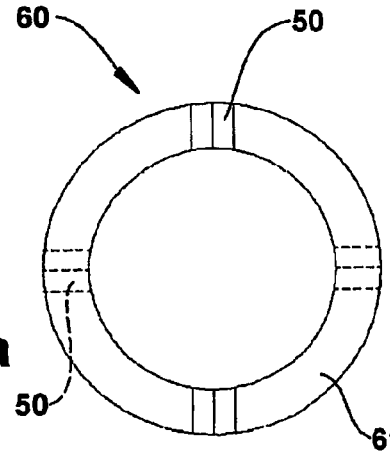
Figure 8C:
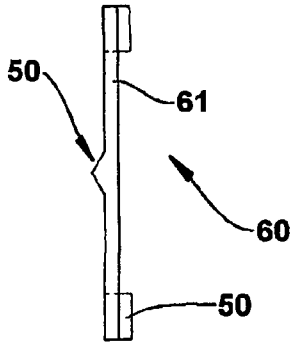
Figure 8B:
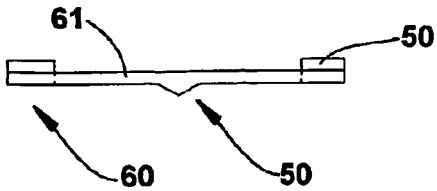
Figure 10A:
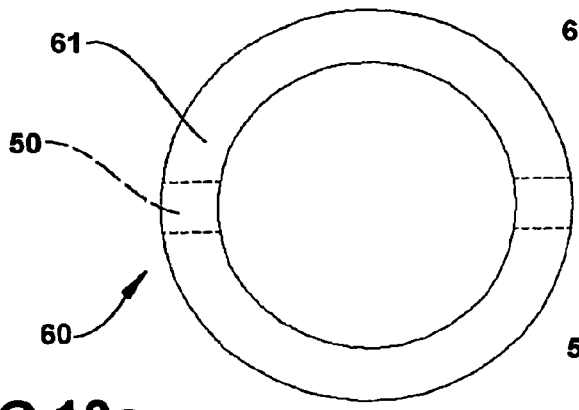
FIGS. 10*a* and 10*b*, 11*a* and 11*b* and 12*a* and 12*b* illustrate, schematically and respectively, front and lateral views of other different constructive forms of the spacing body of the type presented in FIG. 9.
Figure 10B:
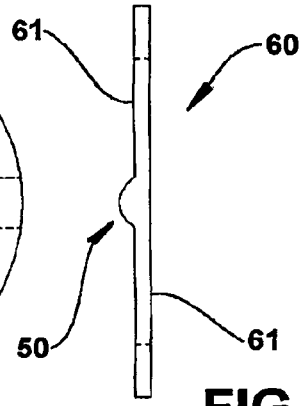
Figure 11A:
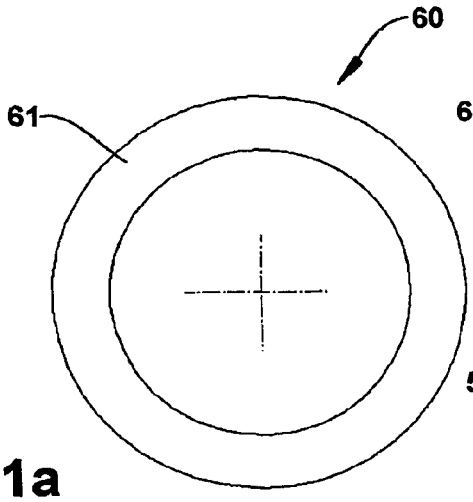
Figure 11B:
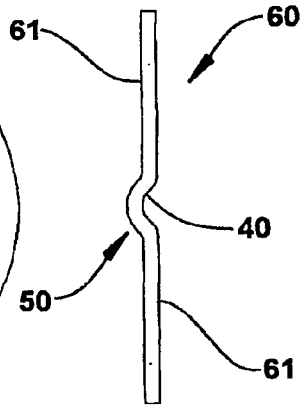
Figure 12A:
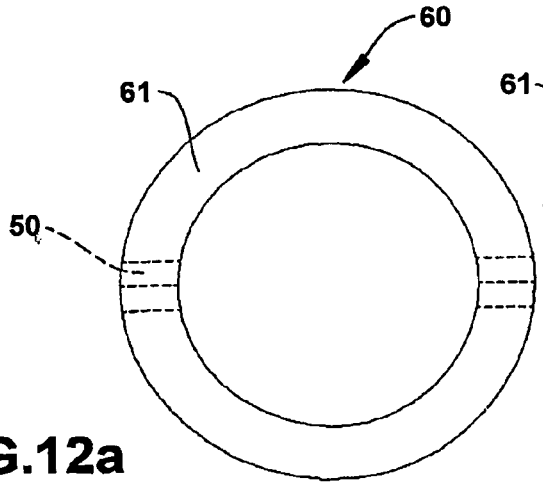
Figure 12B:
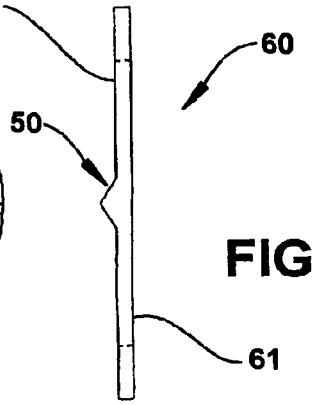

The construction of the spacing body 60 illustrated in FIG. 6 presents, on each seating surface 61, a pair of convex surface portions 50, which are orthogonal to each other and defined as a function of the profile of said spacing body 60, which in this construction is a ring, which is bent in order to present two vertex portions aligned to each other and defining said convex surface portions 50.

In the constructive form illustrated in FIGS. 3–5 and 7–8, the spacing body 60 carries, for example by incorporating two pairs of convex surface portions 50, with each pair being provided on a seating surface 61 of said spacing body 60 and with the alignment of the convex surface portions 50 being disposed orthogonal to the alignment of the convex surface portions 50 provided on the other seating surface 61, in order to define an oscillating support for each helical spring seated against the actuating means 4. In a variant of this construction, the spacing body 60 may carry one of the pairs of the supporting surface portions and the convex surface portions, with the other pair being provided in one or in both parts of the spring means and the actuating means 4.

In another variant of this constructive option, between at least one of the ends of one of the helical springs of the spring means 10, there is provided at least one spacing body 60, with at least one of the seating surfaces 61 thereof carrying at least one of the supporting surface portions 40 and the convex surface portions 50.

According to another constructive option of the present invention, not illustrated, each seating surface 61 of a spacing body 60 carries a respective pair of one of the seating surface portions 40 and the convex surface portions 50 disposed in an alignment orthogonal to the alignment defined by the pair of one of said surfaces carried on the other seating surface 61.

Figure 4:
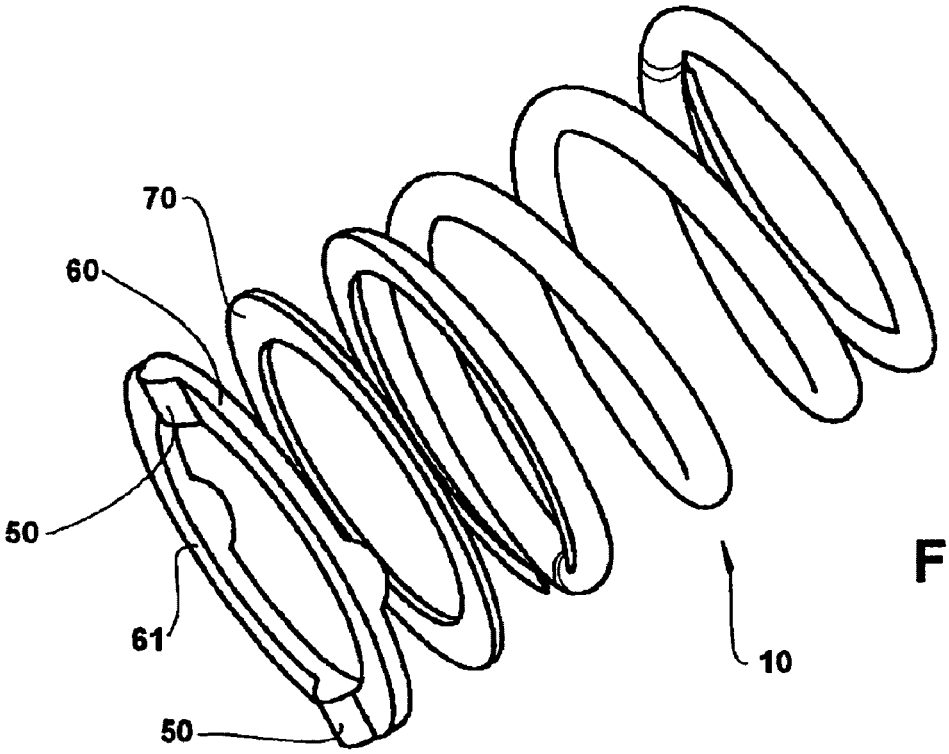
FIG. 4 illustrates, schematically and partially, an exploded perspective view of the constructive option illustrated in FIG. 3 of the present invention, presenting a spacing body provided with a supporting ring, to be seated onto an end portion of the spring means.
Figure 5A:
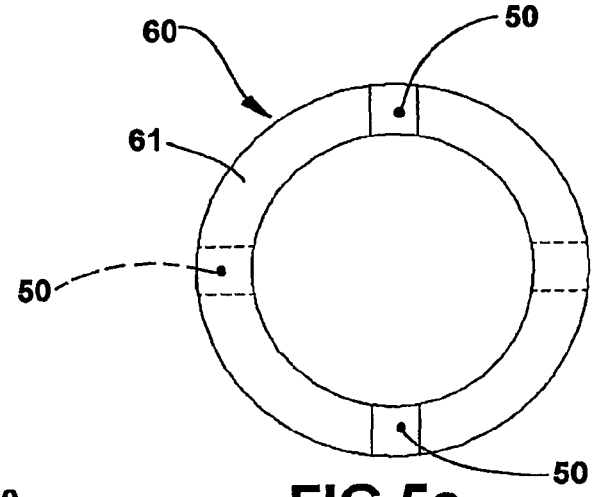
FIGS. 5*a*, 5*b* and 5*c*, 6*a*, 6*b* and 6*c*, 7*a*, 7*b* and 7*c* and 8*a*, 8*b* and 8*c* illustrate, schematically and respectively, front, upper and lateral views of different constructive forms for the spacing body illustrated in FIG. 3.
Figure 5C:
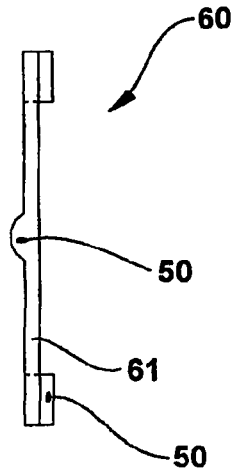
Figure 5B:
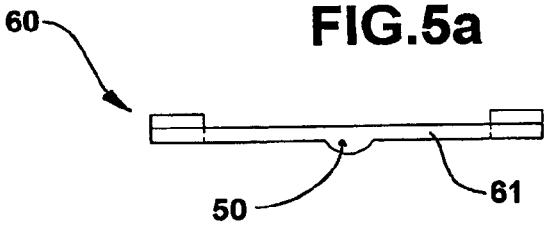

According to the illustration in FIG. 4, between each of the parts of the end coil of at least one of the helical springs of the spring means 10 and the spacing body, is seated a supporting ring 70, for example in the form of a flat disc, defining a respective pair of seating surface portions 40, against which is seated a respective pair of convex surface portions 50.

In the construction illustrated in FIG. 4, the spacing body 60 presents each pair of convex surface portions 50 having the axis orthogonal to the axis of the cylinder 2 and to the other pair of convex surface portions 50, said construction allowing that opposite axial forces, for example with the same intensity, actuating on said pair of convex surface portions 50, be transmitted with no moments to the piston 3.

The invention claimed is:

1. A reciprocating compressor with a linear motor, comprising:

a shell; and a motor-compressor assembly including:

a reference assembly affixed inside the shell and formed by a motor and a cylinder;

a resonant assembly formed by a piston reciprocating inside the cylinder, and by an actuating means operatively coupling the piston to the motor; and a resonant spring means, under constant compression, which is simultaneously mounted to the resonant assembly and to the reference assembly, and which is resiliently and axially deformable in the displacement direction of the piston, wherein the spring means is mounted to the actuating means by the mutual seating of a pair of supporting surface portions, at least one of the latter being operatively associated with one of the parts of the spring means and the actuating means, against a respective pair of convex surface portions, each of the latter being operatively associated with the other of said parts, the convex surface portions being symmetrical and opposite in relation to the axis of the cylinder, the supporting surface portions and the convex surface portions being mutually seated and operatively associated with the respective parts of the spring means and the actuating means, in order to transmit, by the mutually seated surface portions, the opposite axial forces actuating on said parts, with such intensity as to minimize the occurrence of moments on the piston.

2. The reciprocating compressor according to claim 1, wherein the pair of supporting surface portions and the pair of convex surface portions are operatively associated, each pair, with the same respective part.

3. The reciprocating compressor according to claim 1, wherein at least one of the pairs of the supporting surface portions and the convex surface portions is incorporated to a respective part of the actuating means and the spring means.

4. The reciprocating compressor according to claim 3, characterized in that wherein it includes at least one spacing body presenting two seating surfaces disposed in planes orthogonal to the axis of the cylinder and which are axially spaced from each other, each of said seating surfaces facing a respective end surface adjacent to one of the parts of the spring means and the actuating means, at least one of said seating surfaces carrying one of the pairs of the convex surface portions and the supporting surface portions.

5. The reciprocating compressor according to claim 4, wherein each seating surface of a spacing body carries a respective pair of one of the supporting surface portions and the convex surface portions disposed in an alignment orthogonal to the alignment defined by the pair of one of said surfaces carried in the other seating surface.

6. The reciprocating compressor according to claim 5, wherein each seating surface incorporates a respective pair of convex surface portions.

7. The reciprocating compressor according to claim 6, wherein the spacing body is a bent ring.

8. The reciprocating compressor according to claim 7, wherein it includes at least one supporting ring, each seated onto a respective part of the spring means and the actuating means, and each defining a respective pair of supporting surface portions.

9. The reciprocating compressor according to claim 1, wherein the pair of convex surface portions is angularly disposed in relation to a first contact portion of the spring means in relation to the pair of supporting surface portions at an angle (ϕ) taken from the seating direction of the spring means in relation to said contact portion and corresponding to a determined percentage of concentration of forces reacting against the compression of the spring means higher than 50% of said forces on the piston.

10. The reciprocating compressor according to claim 9, wherein said angle (ϕ) is defined between 90 and 180 degrees from the seating direction of the last coil of the spring means.

11. The reciprocating compressor according to claim 10, wherein said angle (ϕ) is preferably between 110 and 120 degrees.

12. The reciprocating compressor according to claim 11, wherein said angle (ϕ) is preferably between 115 and 118 degrees.

13. The reciprocating compressor according to claim 1, wherein the convex surface portions are defined by cylindrical surface portions with the axis orthogonal to the axis of the cylinder.

14. The reciprocating compressor according to claim 1, wherein the convex surface portions are defined by spherical surface portions.

15. The reciprocating compressor according to claim 1, wherein the supporting surface portions are defined by concave surfaces.

16. The reciprocating compressor according to claim 12, wherein the spring means comprises a pair of helical springs, each being mounted against an adjacent surface to the actuating means by the pairs of the convex surface portions and the supporting surface portions.

* * * * *